US007628476B2

(12) United States Patent
Matsuba et al.

(10) Patent No.: US 7,628,476 B2
(45) Date of Patent: Dec. 8, 2009

(54) INK SUPPLIER FOR INK JET RECORDER

(75) Inventors: Hiroyuki Matsuba, Ohnojo (JP); Kazunari Chikanawa, Kasuga (JP); Shigeyuki Takao, Dazaifu (JP); Tetsuya Matsuzaki, Fukuoka (JP); Hideo Izawa, Narashino (JP); Takao Namiki, Narashino (JP)

(73) Assignees: Matsushita Electric Industrial Co., Ltd., Kadoma (JP); Miyakoshi Printing Machinery Co., Ltd., Narashino (JP)

( * ) Notice: Subject to any disclaimer, the term of this patent is extended or adjusted under 35 U.S.C. 154(b) by 69 days.

(21) Appl. No.: 11/115,795

(22) Filed: Apr. 27, 2005

(65) Prior Publication Data

US 2005/0248607 A1 Nov. 10, 2005

(30) Foreign Application Priority Data

May 7, 2004 (JP) ..... 2004-138730
May 10, 2004 (JP) ..... 2004-139638

(51) Int. Cl.
*B41J 2/175* (2006.01)

(52) U.S. Cl. ..... 347/85; 347/84; 347/32

(58) Field of Classification Search ..... 347/84, 347/85, 86, 89, 92, 93, 97, 32, 35
See application file for complete search history.

(56) References Cited

U.S. PATENT DOCUMENTS 4,183,030 A * 1/1980 Kaieda et al. ..... 347/6
4,342,042 A * 7/1982 Cruz-Uribe et al. ..... 347/7
4,502,055 A * 2/1985 Horike et al. ..... 347/92
4,535,339 A * 8/1985 Horike et al. ..... 347/6
6,193,354 B1 * 2/2001 Ito ..... 347/30
6,220,700 B1 4/2001 Haigo
6,485,137 B2 * 11/2002 Karlinski et al. ..... 347/92
6,517,189 B2 * 2/2003 Ogawa et al. ..... 347/35

FOREIGN PATENT DOCUMENTS

| | | | |
|---|---|---|---|
| EP | 0 237 787 | | 9/1987 |
| EP | 0 805 034 | A | 11/1997 |
| EP | 0 950 533 | | 10/1999 |
| JP | 58-212956 | * | 12/1983 |
| JP | 58212956 | A * | 12/1983 |
| JP | 06-106731 | | 4/1994 |
| JP | 07-137286 | | 5/1995 |
| JP | 10 323994 | | 12/1998 |
| JP | 11-20180 | | 1/1999 |

OTHER PUBLICATIONS

Search Report dated Jun. 11, 2007 for the European Application No. 05 10 3284.

* cited by examiner

*Primary Examiner*—Matthew Luu
*Assistant Examiner*—Henok Legesse
(74) *Attorney, Agent, or Firm*—Cohen Pontani Lieberman & Pavane LLP

(57) ABSTRACT

An ink supplier for an ink jet recorder is provided. The ink supplier includes a recording head, a main ink reservoir, and a subsidiary ink reservoir connected to the main ink reservoir for replenishment with ink from the main ink reservoir. A position head of the ink liquid level in the subsidiary ink reservoir is maintained substantially constant relative to a printing head face of the recording head.

3 Claims, 2 Drawing Sheets

INK SUPPLIER FOR INK JET RECORDER

TECHNICAL FIELD

The present invention relates to a ink supplier for supplying a recording head with ink in an ink jet recorder that is capable of continuous printing operation.

BACKGROUND ART

In the ink supply into the recording head in an ink jet recorder, it is necessary that the pressure of ink acting on the recording head be maintained constant and that air bubbles be not included in the ink. As a matter of fact, however, in a conventional ink supplier of this type in which as described, e.g., in JP H06-106731 A, a subsidiary ink reservoir is used in addition to a main ink reservoir for ink storage and operated to supply ink during the recording and the main ink reservoir is operated to replenish ink when the amount of ink in the subsidiary ink reservoir becomes less than an established value, an ink supply pump is used to supply ink into the recording head from the subsidiary ink reservoir and the subsidiary ink reservoir is provided with an air vent such that the liquid level of ink in the subsidiary ink reservoir may communicate through it with the atmosphere.

In the conventional ink supplier described above, a fluctuation in operation of the ink supply pump used to supply ink into the recording head may cause the ink supply pressure on the recording head to fluctuate and in turn cause printing to become unstable. Further, the reservoir (subsidiary ink reservoir) for ink supply to the recording head is provided with the air vent where air in the environment communicates with the ink surface in the reservoir, via which air is entrained into ink in the reservoir. Such entrained air may, when fed to the recording head while being carried in ink, hinder the ink from being discharged out of the recording head in the form of properly regulated, successive droplets.

Further, in the ink jet recorder it is desirable that the pressure of ink supply to the recording head be made optimum individually for each of its operating states, namely during purging, initial charging, printing, wiping of the recording head and cleaning of a wiping blade.

For this purpose, conventional ink suppliers have been designed, as described in JP H11-20180 A and H07-137286 A, to change the ink pressure acting on the recording head by physically raising or lowering the ink reservoir as the ink source to the recording head to change the position head of the ink liquid level in the ink reservoir depending on those states such as printing, wiping of the recording head and others.

To wit, all these conventional ink suppliers have been designed to adjust the height of the ink liquid level relative to the recording head by vertically moving the ink reservoir (main ink reservoir) disposed directly ahead of the recording head for ink supply thereto. It has also been done to control the height (position head) of the ink liquid level by way of software upon measuring the ink supply pressure.

In ink jet recorders for industrial purposes, however, in which their continuous operation is essential, the ink reservoirs must be large in capacity, requiring that they be proportionally large in size and volume, too. Consequently, the drive source and structure need to raise and lower such a main ink reservoir cannot but be large-scaled with conventional techniques, presenting problems in terms of space of placement and manufacturing cost.

Also, as the ink reservoir becomes larger in size, the liquid level becomes controllable less reactively to the ink reservoir raised or lowered. Further, controlling the position head of the ink liquid level by way of software upon measuring the ink supply pressure makes the controller complicated and thus poses the cost problem.

DISCLOSURE OF THE INVENTION

Accordingly, it is a first object of the present invention to provide an ink supplier capable of maintaining ink supply pressure to a recording head constant while supplying the recording head with ink with an minimum of air entrained therein.

In order to achieve the first object mentioned above there is provided in accordance with the present invention in a first aspect thereof an ink supplier for an ink jet recorder, including a recoding head, a main ink reservoir and a subsidiary ink reservoir connected to the main ink reservoir for replenishment with ink from the main ink reservoir, characterized by a means whereby a position head of the ink liquid level in the subsidiary reservoir is maintained substantially constant relative to a printing head face of the recording head.

The ink supplier constructed as mentioned above wherein the position head of the ink liquid level in the subsidiary ink reservoir is maintained substantially constant relative to the printing head face of the recording head allows ink supply pressure (back pressure) to the recording head to be maintained substantially constant, thereby permitting an printing operation by the recording head to proceed stably.

In the ink supplier for an ink jet recorder mentioned above, the means may include an ink supply conduit connected between the main and subsidiary ink reservoirs, an ink supply pump in the ink supply conduit for supplying ink from the main ink reservoir to the subsidiary ink reservoir, a level detector associated with the subsidiary ink reservoir for detecting an ink liquid level therein and a controller responsive to a detection value of the level detector for controlling ink replenishment by the ink supply pump so as to maintain the position head of the ink liquid level in the subsidiary ink reservoir substantially constant.

According to the features mentioned above, the means for maintaining substantially constant the position head of the ink liquid level in the subsidiary ink reservoir relative to the printing head face of the recording head can be implementation in a simple makeup.

In the ink supplier for an ink jet recorder mentioned above, there may further be provided a deaerator associated with the subsidiary ink reservoir for removing air from ink therein and a float floating on ink in the subsidiary ink reservoir so as to cover the ink substantially over its entire surface.

These features allow not only extracting air from ink in the subsidiary ink reservoir with an deaerator but also controlling air entry into the ink being supplied from the subsidiary ink reservoir to the recording head. Further, having a float floating on the liquid surface of ink in the subsidiary ink reservoir so as to cover the ink surface permits isolating the ink surface from air in the reservoir, thereby minimizing air entry into the ink. This in turn minimizes occurrence of sorts of trouble accompanying air entry into ink when the ink is discharged out of the nozzles of the recording head in the form of successive droplets, thereby giving rise to stable printing.

It is a second object of the present invention to make light equipped, and to permit manufacturing at reduced cost, a mechanism required to adjust the position head for ink supply.

In order to achieve this object, there is provided in accordance with the present invention in a second aspect thereof, an ink supplier for an ink jet recorder, including a recording head and a main ink reservoir, characterized in that it comprises: a back pressure reservoir connected between the recording head and the main ink reservoir for replenishment with ink from the main ink reservoir, the back pressure reservoir being adapted to maintain a height of the ink liquid level substantially constant against an amount of ink consumption by the recording head; and a means for adjusting the back pressure reservoir in its vertical position, thereby adjusting a position head of the ink liquid level in the back pressure reservoir relative to a printing head face of the recording head.

According to the features mentioned above, the back pressure reservoir designed to be moved vertically to adjust the position head of the ink liquid level therein relative to the recording head can be made compact and light-weighted compared with the main ink reservoir, thereby permitting the position head adjusting mechanism designed to move the back pressure reservoir vertically to adjust the position head to be made light equipped and manufactured at reduced cost.

Also, the back pressure reservoir for varying position heads which is made compact and reduced in capacity betters the responsiveness in level control by its vertical movement while improving its maintainability. Further, adjusting the position head of the ink liquid level by moving the back pressure reservoir vertically makes the controller simpler than by controlling the position head of the ink liquid level by way of software upon measuring the ink supply pressure, and thus renders the controller less costly.

In this case, the main ink reservoir will be located in a space like at the motive power side and the back pressure reservoir smaller in size than the main ink reservoir will be placed beside the recoding head; hence the makeup at the recoding head side can also be made compact. Moreover, with the back pressure reservoir kept replenished with ink against ink consumption by the recording head, the ink jet printer is allowed to operate continuously over an extended period of time.

Yet further, since the position head of the ink liquid level can be adjusted as desired mechanically by the back pressure reservoir, the supply ink pressure can be precisely controlled individually when the recording head is to be placed in each of different modes of such as ink loading, purging, printing and wiping.

In the makeup mentioned above, the means may specifically include a lifting unit for supporting the back pressure reservoir so that it can be moved vertically whereby the position head of the ink liquid level in the back pressure reservoir relative to the printing head face of the recording head may have a height $H_1$ for a printing operation which is lower than the printing head face of the recording head, a height $H_2$ for a wiping operation which is higher than the printing head face of the recording head, a height $H_3$ for a purging operation which is higher than that for the wiping operation and a height $H_4$ for an initial charging operation which is higher than that for the purging operation. Then, in a preferred example, the height $H_1$ for an printing operation is about −20 mm, the height $H_2$ for a wiping operation ranges from 10 to 20 mm, the height $H_3$ for a purging operation ranges from 35 to 45 mm and the height $H_4$ for an initial charging operation is about 45 mm. In another preferred example, the height $H_1$ for an printing operation is about −30 mm, the height $H_2$ for a wiping operation ranges from 10 to 20 mm, the height $H_3$ for a purging operation ranges from 40 to 100 mm and the height $H_4$ for an initial charging operation is about 300 mm.

BRIEF DESCRIPTION OF THE DRAWINGS

These and other objects, features and advantages of the present invention as well as other manners of its implementation will become more readily apparent, and the invention itself will also be better understood, from the following detailed description when taken with reference to the drawings attached hereto showing certain illustrative forms of implementation of the present invention. In the drawings.

BEST MODES FOR CARRYING OUT THE INVENTION

Figure 1:
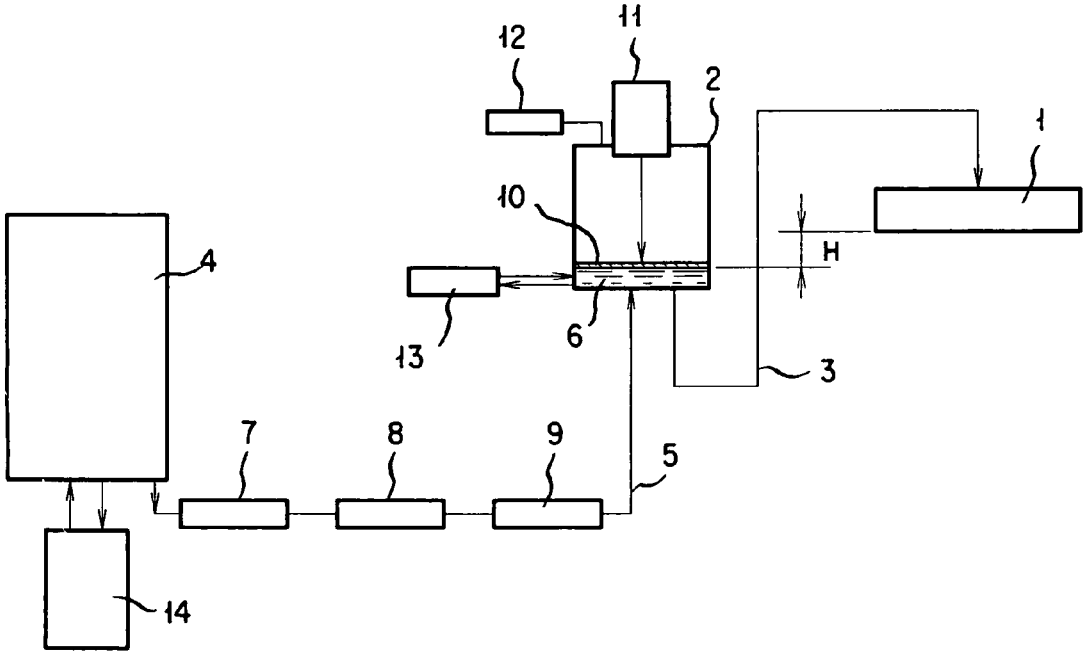
FIG. 1 is an explanatory view diagrammatically illustrating an ink supply system in an ink supplier according to a first form of implementation of the present invention.

Mention is first made of a first form of implementation of the present invention. FIG. 1 is an explanatory view diagrammatically illustrating an ink supply system in an ink supplier according to the first form of implementation of the present invention.

An ink jet recorder shown in FIG. 1 includes a recording head 1, a subsidiary ink reservoir 2 connected via an ink supply conduit 3 to the recording head 1 and a main ink reservoir 4 connected via an ink supply conduit 5 to the subsidiary ink reservoir 2. The ink supply conduit 5 interconnecting the main ink reservoir 4 and the subsidiary ink reservoir 2 is provided with an ink supply pump 7, a filter 8 and an electromagnetic valve 9. The ink supply pump 7 here is provided to replenish the subsidiary ink reservoir 2 with ink from the main ink reservoir 4 against an amount of consumption of ink 6 in the subsidiary ink reservoir 2. The ink supply conduits 3 and 5 lie each at a position lower than such as the bottom of the subsidiary ink reservoir 2, namely lower than at least an ink liquid level therein.

For the recording head 1, use is made of one that uses an electromechanical transducer such as a piezo element whose operation is controlled by a controller not shown.

In the subsidiary ink reservoir 2, a float 10 is floated on ink 6 stored therein and has enough area to contact the whole surface of the ink. The subsidiary ink reservoir 2 also has a level detector 11 for detecting the height of the liquid level of ink 6 by detecting the position of the float 10 therein. And, the operations of the ink supply pump 7 and the electromagnetic valve 9 are controlled by the controller (not shown) in response to a detection value of the level detector 11.

More specifically, while ink 6 in the subsidiary ink reservoir 2 is being supplied via the ink supply conduit 3 into the recording head 1, when its level in the subsidiary ink reservoir 2 drops below an established level, this is detected by the level detector 11 which then issues a signal to open the electromagnetic valve 9 and also to actuate the ink supply pump 7, whereby ink is supplied from the main ink reservoir 4 into the subsidiary ink reservoir 2. When ink is so supplied and its level in the subsidiary ink reservoir 2 is returned to such an established level, this is detected by the level detector 11 which then issues a signal to deactuate the ink supply pump 7 while closing the electromagnetic valve 9 so that ink supply to the subsidiary ink reservoir 2 is terminated. In this way, the liquid level of ink 6 in the subsidiary ink reservoir 2 is maintained always constant at a selected height.

As a result, the relative position in height between the liquid level of ink 6 in the subsidiary ink reservoir 2 and a head face of the recording head 1 is maintained constant, whereby the liquid level of ink 6 there has its position head H that is maintained substantially constant relative to the printing head face of the recording head 1. It should be noted here that the subsidiary ink reservoir 2 lies in communication with the atmosphere via a filter 12.

At a vertical position lower than the liquid level of ink 6 in the subsidiary ink reservoir 2, there is connected thereto a deaerator 13 for extracting air from ink 6 therein. Also, the main ink reservoir 4 has a deaerator 14 connected thereto for extracting air from ink therein. Both the deaerators 13 and 14 may each be of circulatory type whereby air is removed from ink in each reservoir by passing ink in the reservoir through each deaerator 13, 14.

In operation, printing is effected by the recording head 1 operated under control of the controller (not shown) on a sheet of paper (recordable paper) traveling at a position spaced apart by a distance of 0.5 to 1.5 mm below the lower surface of the recording head 1.

Then, the recording head 1 is supplied with ink from the subsidiary ink reservoir 2 via the ink supply conduit 3 in an amount corresponding to that in which ink is discharged from the recording head 1. Ink supply into the recording head 1 here is brought about by capillary actions in the ink supply system and also under a discharge force at the ink discharge nozzle section of the recoding head 1. And, since the level in height of ink 6 in the subsidiary ink reservoir 2 is maintained constant by the ink supply pump 7 whose operation is controlled in accordance with a detection value of the level detector 11, and the position head H of the liquid level of ink in the subsidiary ink reservoir 2 is thereby maintained constant relative to the printing head face of the recording head 1, the ink supply pressure at the discharge nozzle section of the recording head 1 is maintained substantially constant.

Then, the subsidiary and main ink reservoirs 2 and 4 are also deaerated by the deaerators 13 and 14 connected thereto, respectively.

Also, since the surface of ink 6 in the subsidiary ink reservoir 2 is covered generally over its entire area with the float 10 and, as a result, is virtually held against contacting the atmosphere directly, the entry of air into the ink through this liquid surface can be minimized.

From the above, it is seen that all sorts of trouble accompanying air entry into ink when the ink is discharged out of the nozzles of the recording head 1 in the form of successive droplets are minimized, thereby giving rise to stable printing.

Figure 2:
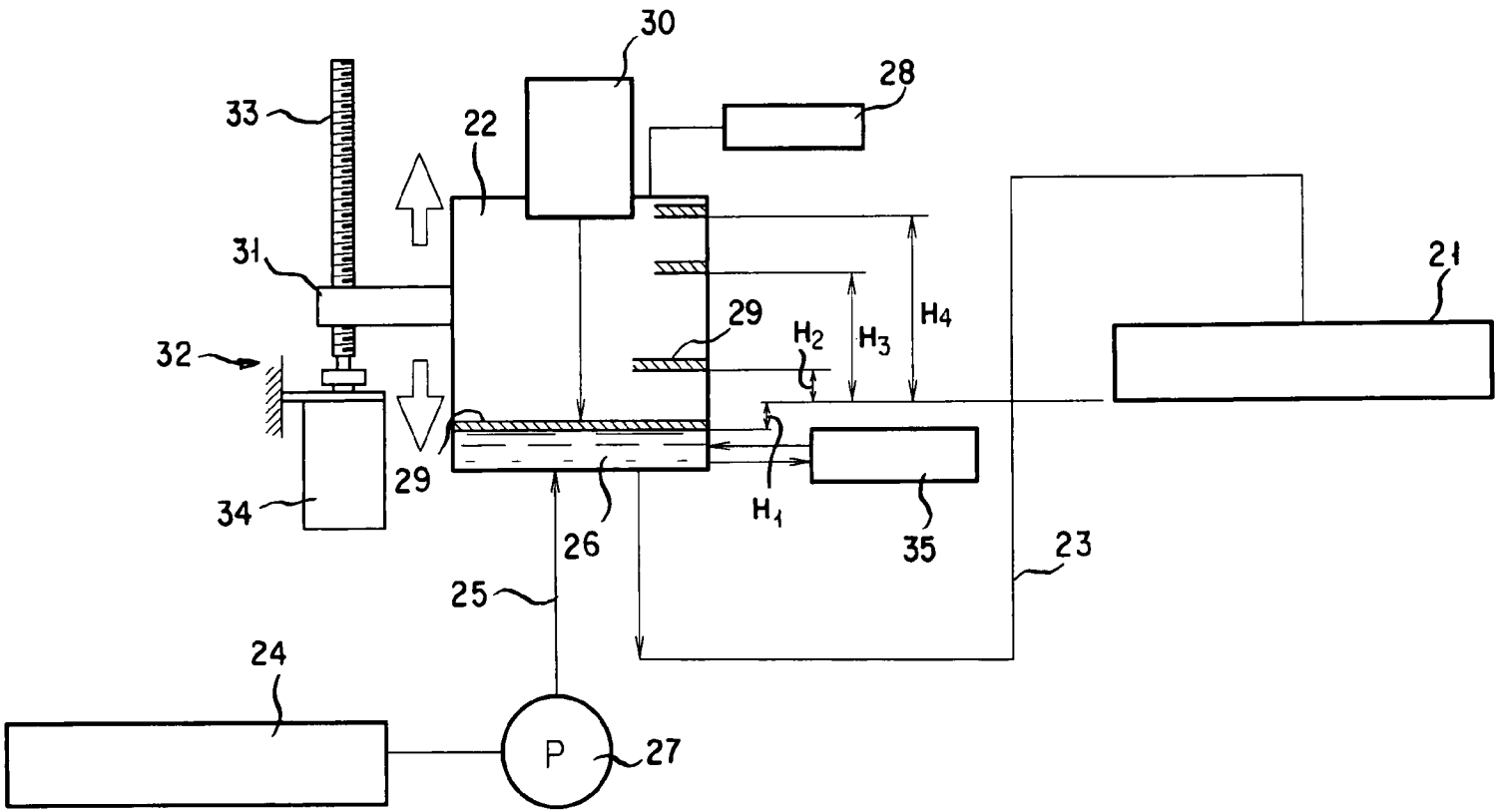
FIG. 2 is an explanatory view diagrammatically illustrating an ink supply system in an ink supplier according to a second form of implementation of the present invention.

Mention is next made of a second form of implementation of the present invention. FIG. 2 is an explanatory view diagrammatically illustrating an ink supply system in an ink supplier according to the second form of implementation of the present invention.

An ink jet recorder shown in FIG. 2 includes a recording head 21, a back pressure reservoir (subsidiary ink reservoir) 22 connected via an ink supply conduit 23 to the recording head 21 and a main ink reservoir 24 connected via an ink supply conduit 25 to the back pressure reservoir 22. The ink supply conduit 25 interconnecting the main ink reservoir 24 and the back pressure reservoir 22 is provided with an ink supply pump 27, which is provided to replenish the back pressure reservoir 22 with ink from the main ink reservoir 24 as ink 26 in the back pressure reservoir 22 is consumed. The ink supply conduits 23 and 25 lie each at a position lower than at least an ink liquid level therein, namely a position such as the bottom of the back pressure reservoir 22. Further, the back pressure reservoir 22 is in communication with the atmosphere via a filter 28.

For the recording head 21, use is made of one that uses an electromechanical transducer such as a piezo element whose operation is controlled by a controller not shown.

In the back pressure reservoir 22, a float 29 is floated on ink 26 stored therein and has enough area to contact the whole surface of the ink. The back pressure reservoir 22 also has a level detector 30 for detecting the height of the liquid level of ink 26 by detecting the position of the float 29 therein. And, the operation of the ink supply pump 27 is controlled by the controller (not shown) in response to a detection value of the level detector 30.

More specifically, while ink 26 in the back pressure reservoir 22 is being supplied via the ink supply conduit 23 into the recording head 21, when its level in the back pressure reservoir 22 drops below an established level, this is detected by the level detector 30 which then issues a signal to actuate the ink supply pump 27, whereby ink is supplied from the main ink reservoir 24 into the back pressure reservoir 22. When ink is so supplied and its level in the back pressure reservoir 22 is returned to such an established level, this is detected by the level detector 30 which then issues a signal to deactuate the ink supply pump 27 so that ink supply to the back pressure reservoir 22 is terminated. In this way, the liquid level of ink 26 in the back pressure reservoir 22 is maintained always constant at a selected height.

The back pressure reservoir 22 is supported by a lifting unit 32 with the intermediary of a bracket 31. The lifting unit 32 comprises a vertical threaded shaft 33 screwed in the bracket 31 and a motor 34 that can be rotated in both directions to rotate the threaded shaft 33 in either direction vertically and thereby to raise or lower the back pressure reservoir 22. Thus, rendering the back pressure reservoir 22 movable vertically allows the position head of the liquid level of ink therein to be varied as desired with respect to the printing head face of the recording head 21.

At a vertical position lower than the liquid level of ink 26 in the back pressure reservoir 22, there is connected thereto a deaerator 35 for extracting air from ink 26 therein. The deaerator 35 may be of circulatory type whereby air is removed from ink in the reservoir by passing ink in the reservoir through the deaerator 35.

In operation, printing is effected by the recording head 21 operated under control of the controller (not shown) on a sheet of paper (recordable paper) traveling at a position spaced apart by a distance of 0.5 to 1.5 mm below the lower surface of the recording head 21.

Then, the amount of ink in the back pressure reservoir 22 is maintained constant by the ink supply pump 27 whose operation is controlled in response to a detection value of the level detector 30. On the other hand, the height of the ink liquid level, namely its position head, relative to the printing head face of the recording head 21 can be varied by moving the back pressure reservoir 22 vertically by means of the lifting unit 32.

Here, the position head of the liquid level of ink relative to the printing head face of the recording head 1 is set at different values $H_1$, $H_2$, $H_3$ and $H_4$ selectively for different modes in which the ink jet printer is to be placed, i.e., for printing, wiping, purging and initial charging, respectively. Then, as indicated in FIG. 2 the position head $H_1$ for the printing mode is set to be lower than the printing head face of the recording head 21, the position head $H_2$ for the wiping mode is set to be higher than the printing head face of the recording head 21, the position head $H_3$ for the purging mode is set to be higher than $H_2$ for the wiping mode and the position head $H_4$ for the initial charging is set to be higher than $H_3$ for the purging mode.

To wit, the position head (height) $H_4$ for the initial charging which needs to draw air out of the ink supply conduit 23 between the back pressure reservoir 22 and the recording head 21 and then to fill the ink supply conduit 23 with ink should be the highest. The position head (height) $H_3$ for the purging operation which to resume printing with a short rest time period after printing is performed to purge or expel dust, solid ink and entrained air and replace them with fresh ink in the ink supply conduit 23 should also be a height near the position head (height) $H_4$ for the initial charging.

For the printing operation, ink should properly have a negative pressure to the recording head 21 and the position head $H_1$ (height) should then be a height lower than the printing head face of the recording head 21. On the other hand, the position head (height) $H_2$ during the wiping operation should be somewhat positive. An example is taken as $H_1$ for printing: about −20 mm, $H_2$ for wiping: 10 to 20 mm, $H_3$ for purging: 35 to 45 mm and $H_4$ for initial charging: about 45 mm. Another example is taken as $H_1$ for printing: about −30 mm. $H_2$ for wiping: 10 to 20 mm, $H_3$ for purging: 40 to 100 mm and $H_4$ for initial charging: about 300 mm. These values change depending on performance of the recording head, ink properties and specific details of the ink supply system.

In the makeup mentioned above, the back pressure reservoir 22 may have a capacity sufficient if it is commensurate with the printing speed in the recording head. Since it may be smaller in capacity than the main ink reservoir 24, the back pressure reservoir 22 is made smaller than the main ink reservoir 24 in size and weight as well.

What is claimed is:

1. An ink supplier for an ink jet recorder, including a recording head and a main ink reservoir, comprising:

a back pressure reservoir connected between the recording head and the main ink reservoir for replenishment with ink from the main ink reservoir, said back pressure reservoir being configured to maintain a height of the ink liquid level therein substantially constant against an amount of ink consumption by the recording head; and a means for adjusting the back pressure reservoir in its vertical position, thereby adjusting a position head of the ink liquid level in the back pressure reservoir relative to a printing head face of the recording head;

wherein said means includes a lifting unit for supporting the back pressure reservoir so that it moves vertically wherein the position head of the ink liquid level in the back pressure reservoir relative to the printing head face of the recording head has a height $H_1$ for a printing operation which is lower than the printing head face of the recording head, a height $H_2$ for a wiping operation which is higher than the printing head face of the recording head, a height $H_3$ for a purging operation which is higher than that for the wiping operation and a height $H_4$ for an initial charging operation which is higher than that for the purging operation.

2. The ink supplier for an ink jet recorder as set forth in claim 1, wherein the height $H_1$ for a printing operation is about −20 mm, the height $H_2$ for a wiping operation ranges from 10 to 20 mm, the height $H_3$ for a purging operation ranges from 35 to 45 mm and the height $H_4$ for an initial charging operation is about 45 mm.

3. The ink supplier for an ink jet recorder as set forth in claim 1, wherein the height $H_1$ for a printing operation is about −30 mm, the height $H_2$ for a wiping operation ranges from 10to 20 mm, the height $H_3$ for a purging operation ranges from 40 to 100 mm and the height $H_4$ for an initial charging operation is about 300 mm.

* * * * *